United States Patent [19]

Abboud

[11] Patent Number: 4,730,564

[45] Date of Patent: Mar. 15, 1988

[54] MULTI-STAGE KILN

[76] Inventor: Harry I. Abboud, 5845 Clematis Dr., Baton Rouge, La. 70808

[21] Appl. No.: 59,127

[22] Filed: Jun. 8, 1987

[51] Int. Cl.[4] ..... A47J 36/00; A47J 36/24

[52] U.S. Cl. ..... 110/246; 110/240; 110/241; 432/106

[58] Field of Search ..... 110/246, 346, 241, 240; 432/103, 106

[56] References Cited

U.S. PATENT DOCUMENTS

| | | | |
|---|---|---|---|
| 2,695,461 | 11/1954 | Langley et al. | 34/181 |
| 3,097,833 | 7/1963 | Harris et al. | 432/106 |
| 3,678,598 | 7/1972 | Quillez | 34/128 |
| 3,882,800 | 5/1975 | du Chambon | 110/246 X |
| 4,014,106 | 3/1977 | Bearce | 34/142 |
| 4,175,335 | 11/1979 | Avril | 432/106 X |
| 4,354,826 | 10/1982 | Kruger et al. | 432/18 |
| 4,361,100 | 11/1982 | Hinger | 110/246 X |
| 4,639,217 | 1/1987 | Adams | 110/246 X |

*Primary Examiner*—Edward G. Favors

*Attorney, Agent, or Firm*—Llewellyn A. Proctor

[57] ABSTRACT

A multi-stage rotary kiln for burning waste, suitably skid mounted for ease of transport. The kiln includes a pair of concentric tubes affixed one inside the other and rotatable; a first large diameter tube and a second tube of smaller diameter, provided at one end with circumferential wall openings, mounted inside said first large diameter tube. An annular passageway between the two tubes, and opening through the second small diameter tube provides a continuous flow path for the introduction of waste and hot burning gases, the hot gases flowing cocurrently with the waste via the annular passageway, and circumferential openings into and through the second tube. A feed mechanism introduces waste into the annular passageway, elevator means lifts the burning waste from the annular passageway and passes same into the circumferential openings, and the burning waste is transported through the smaller tube and discharged.

15 Claims, 4 Drawing Figures

MULTI-STAGE KILN

FIELD OF THE INVENTION

This invention relates to a multi-stage rotary kiln, or incinerator, useful for the disposal of hazardous and non-hazardous burnable wastes, notably waste oil sludges, or slurries, such as produced in oil well drilling. In particular, it relates to a high efficiency rotary multi-stage kiln, or incinerator, to achieve high efficiency and effectiveness, and especially to such apparatus which can be readily transported to and from a waste oil pit for clean up of the site.

BACKGROUND

Kilns, and incinerators, for the treatment of numerous wastes have been known for many years. The necessity to treat municipal and industrial wastes has long been a problem, and now the treatment of industrial wastes is assuming a role of growning importance due to environmental factors.

In the oil producing states of this country, e.g., the problem of cleaning up waste oil pits is one of paramount importance, and is becoming acute. The quantity of waste oil contamination at oil field drilling sites has become a problem of immense magnitude, and the necessity of hauling the accumulated contaminated material from widespread areas of contamination to a central decontamination site aggravates the problem considerably.

In burning hazardous wastes the problem is particularly intense in that not only must these wastes be rapidly disposed of before harm can be done to the environment, but additionally when burning the hazardous materials the destruction of the chemicals must be sufficiently complete that the gases evolved from the combustion must be non-hazardous. To completely decompose most of these chemicals highly efficient, high temperature combustion is generally essential because incineration of most of these substances is relatively costly.

OBJECTS

Accordingly, it is a primary objective of this invention to provide an improved kiln, or incinerator, which will more effectively and efficiently consume burnable wastes without producing high concentrations of airbourne or solids pollutants.

A specific object is to provide an improved kiln, or incinerator such as characterized, which can be readily transported to a contamination site, clean up of the site accomplished, and the kiln, or incinerator, then readily transported to another site.

A further, and more specific, object is to provide a portable multi-stage kiln, or incinerator, of compact design which is particularly effective for use in the clean up of waste oil pits, these wastes being burned in the kiln at the actual site of contamination, and thereafter the kiln is readily removed and transported elsewhere on completion of the clean up.

THE INVENTION

These objects and others are achieved in accordance with the present invention embodying apparatus characterized as a multi-stage rotary kiln, or incinerator. At the heart of the kiln, or incinerator, lies a pair of concentrically aligned, telescoped, rotatable tubes, a first outer tube of cylindrical shape, preferably of conoidal or frusto conic shape the large diameter end of which is closed, and a second tube of sufficiently small diameter to provide an annular passageway between the side walls of the two tubes of downward slope. The wall of the second tube lying at the closed end of the larger diameter tube is provided with circumferential side openings which communicate the axial opening of the second tube with said annular passageway, this providing a continuous flow path running the cumulative length of the two tubes. The second tube, and consequently the axial opening thereof, is also sloped downwardly in direction opposite to that provided by the annular passageway. Waste oil, sludge or slurry feed means are located at the small diameter end of the first tube, elevator means are located within the large diameter end of the first tube, both tubes are affixed together and simultaneously rotatable. The first tube is rotatable within a burner-containing burner box located at the small diameter end of the said first tube, and air (oxygen) rich burning gases from the burner box enter the annular passageway, dry, ignite and burn the waste oil, sludge or slurry feed and move cocurrently therewith through the annular passageway to the large diameter end of said first tube. A burner is also contained within and extended through the closed large diameter end of the first tube into the axial opening of the second tube, a chimney is located at the opposite end of the second tube, and all these elements are mounted upon a skid for ease of transportation of the kiln to an oil waste pit. Waste oil, sludge or slurry fed into the small diameter end of the first tube into the annular passageway, as suggested, is burned at least in part as hot gases flow cocurrently with the burning waste oil, sludge or slurry downwardly from the small diameter end to the large diameter end of said first tube where the residue is then lifted by the elevator means and fed with the air (oxygen) rich burning gases via the circumferential openings into the second tube. Gases from the burner extending into the axial opening of the second tube and from the annular passageway flowing through the circumferential openings within the wall of the second tube now flow in the opposite direction cocurrently with the flow of residual solids, the combustion of all of the noxious components is completed, and both the gases and solids are discharged via the discharge end of the second tube into the chimney.

These and other features of this novel apparatus, as well as its principle of operation, will be better understood by reference to the following drawing and detailed description of a preferred kiln, or incinerator. Specific reference is made to the drawing. In the drawing, similar numbers are used in the different figures to represent similar parts or components, and subscripts are used with a whole given number to designate similar parts or components where a plurality of such parts or components are employed in the structure. When a whole number is used in the text to designate parts or components present in the structure in numbers greater than one, the reference is intended in a generic sense.

REFERENCE TO THE DRAWING

In the drawing:

FIG. 1 is a side elevation view in section depicting a skid mounted multi-stage kiln, or incinerator, inclusive of pair of tubes of the kiln which are affixed one within the other and mounted upon the skid, the first, or outer tube being supported via a pair of tires, or tracks on trunnions, or rolls, and motor driven to rotate both tubes simultaneously; each tube being sealed and rotatably mounted within a burner box with which the first tube is in open communication, while the open end of the second or inner tube is extended into the chimney. Waste feed is introduced via feed input means into the rearward end of the first kiln, burned in a concurrently moving burner gas stream, the residue is lifted via elevator means into the forward section of the second, or inner tube, and then further burned in a cocurrently moving burner gas stream as it is passed back in the general direction of feed input to the chimney. The skid in turn is mounted on a trailer for tow to and from an operating site.

Figure 1:
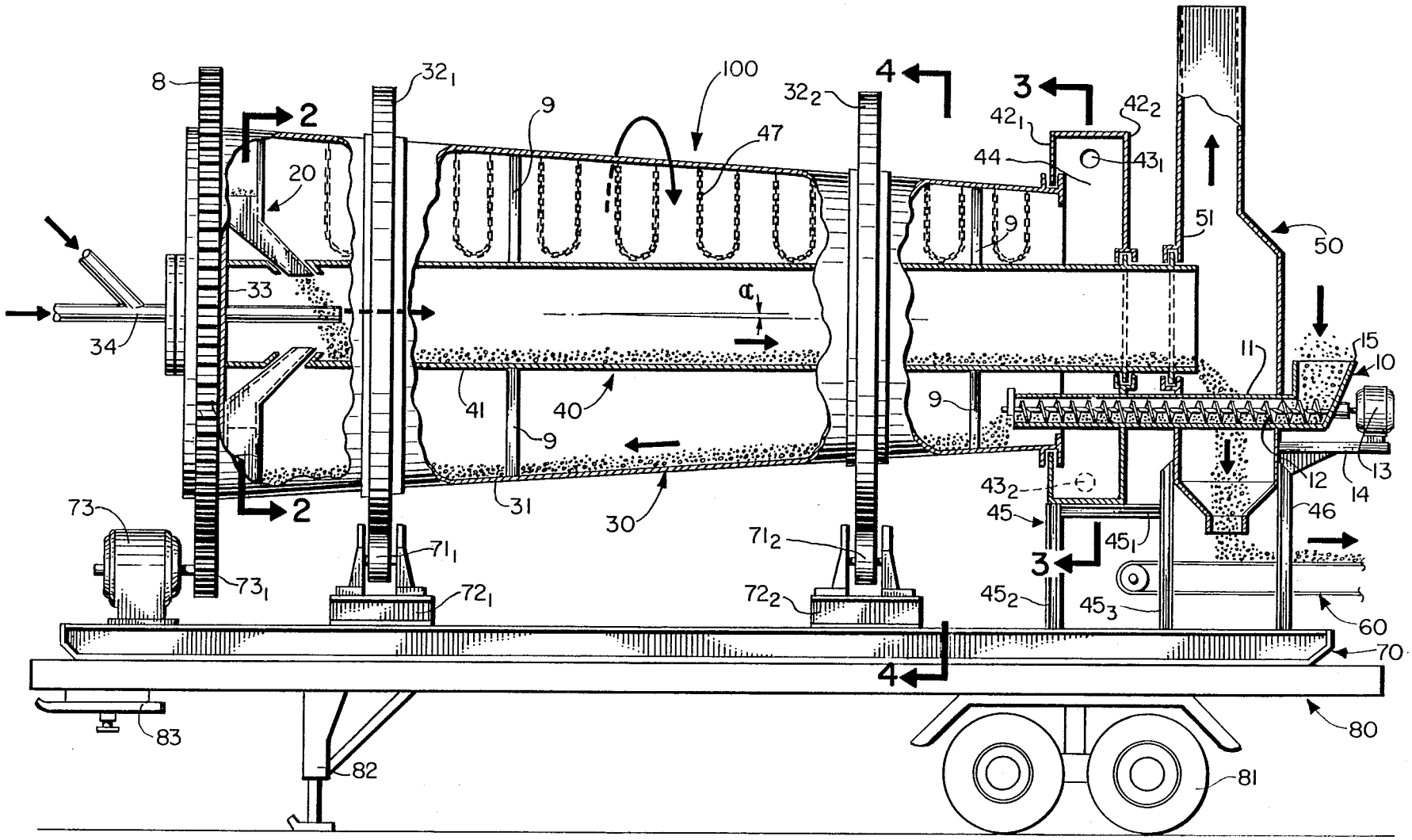
Figure 3:
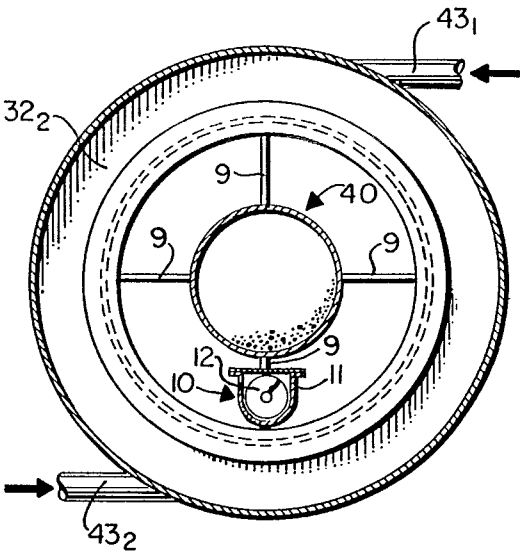
FIG. 3 is a section taken along line 3—3 of FIG. 1 which depicts the burner box.
Figure 4:
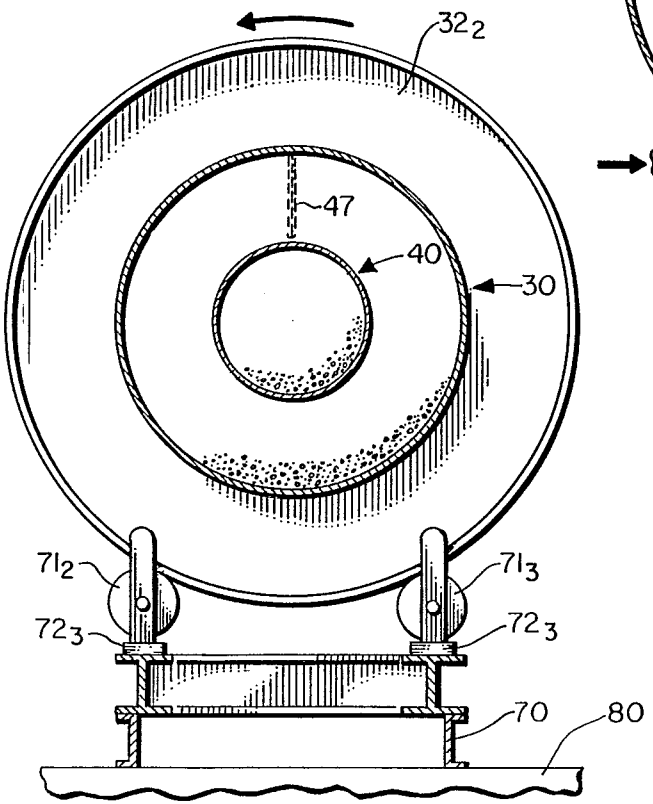
FIG. 4 is a section taken along line 4—4 of FIG. 1 depicting the means by which the tubes of the kiln are rotatably supported.

Referring first, generally, to FIG. 1 there is depicted a cross-sectional side elevation view of a kiln, or incinerator 100 mounted upon a skid 70, which in turn is transportable upon a towable wheeled trailer 80, as to a site which is to be cleared of a burnable waste. The kiln, or incinerator 100 is constituted principally of a pair of concentric tubes 30, 40, a small diameter tube 40 rigidly affixed within a larger diameter tube 30, both rotatably supported upon the skid 70 via a pair of parallelly aligned circumferential tires $32_1$, $32_2$ which ring the outer side wall forming the larger tube 30, and these in turn rest upon trunnions, or rollers $71_1$, $71_2$, respectively, suitably supported by bearings (not shown), and these in turn are mounted upon a base $72_1$, $72_2$, respectively, attached to the floor of skid 70. The concentric tubes 30, 40 are rotated together, in the same direction, e.g., in a clockwise direction, via a drive mechanism constituted of a motor 73, mounted atop the skid 70, linked via a gear combination to the large forward end of the tube 30. The outer side wall of tube 30 thus carries a circumferential gear 8, the drive shaft of the motor 73 carries a gear $73_1$, and the two gears 8, $73_1$ are meshed together such that the tube 30, and consequently also tube 40, affixed therein, is rotated by activation of motor 73.

The small diameter, or rearward end of tube 30 is rotatably affixed and sealed within the front wall $42_1$ of the burner box 44, and the rearward end of tube 40 is rotatably affixed and sealed within rear wall $42_2$ of the burner box 44. The rearward end of the tube 40 is also rotatably mounted and sealed within the forward wall 51 of a chimney, or stack 50, and its rearward end opens into said chimney 50. Both of tubes 30, 40 are rotated by the motor 73. During operation, while the tubes 30, 40 are rotated gases and solids are discharged from the open rearward end of tube 40 into chimney 50. Burnable waste is introduced into the large tube 30 via screw conveyer means 10 located to the side of, and adjacent the chimney, or stack 50. The residual particulate matter, which travels the length of tube 30 to its forward end is lifted via elevator mechanism 20 and discharged into the forward end of tube 40 from whence it is discharged from the terminal end thereof into chimney 50.

A key and novel feature of this invention is that in the kiln 100 the air (oxygen) rich burning gases and waste are moved cocurrently from the point of waste feed entry to the point of burnt waste discharge providing maximum contact time between the burning gases and the waste. Minimal space is utilized because the tubes are telescoped together in such manner that waste is both entering and leaving at virtually any given cross-section of the kiln after introduction of waste into the kiln, and burning continues throughout the entire period. The waste in the center tube is not only heated by the burning gases directly injected therein, but the wall of this tube is additionally heated by the gases burning in the surrounding tube. Moreover, due to its compactness, the kiln and its essential auxiliary components can be mounted on a single skid, hauled on a trailer to a waste location site, and put into use. The entire skid 70, on which the kiln 100 is mounted, can thus be placed on top of a trailer 80, the rearward and of which is provided with tandem aligned axles and wheels mounted thereon, 81, forward strut 82 on which the trailer can rest, and hitch 83 by which the trailer can be towed to a waste site.

At the heart of the kiln, or inceinerator 100 lies the pair of concentric tubes, the first tube 40 of relatively small diameter affixed via struts 9 to, mounted and sealed within the larger diameter tube 30. The larger diameter outer tube 30 is preferably of frusto conic or conoidal shape, its outer wall 31 converging from an enlarged forward diameter portion to a smaller diameter rearward portion which is sealed within a forward stationary burner box 44 enclosed by walls which include wall $42_1$, constituting the forward wall of the burner box within which burners $43_1$, $43_2$ are tangentially mounted. The burner box 44 is in turn supported above the floor of the skid 70 upon framework 45, which includes a horizontal deck $45_1$, supported by vertical posts $45_2$, $45_3$ (and other posts and braces not shown). The chimney, or stack 50 is also supported in an elevated position above the floor of skid 70 via support structure $45_1$ inclusive of vertical posts $45_3$, 46 (and other posts and braces not shown). The opposite, or forward end of the larger tube 30 is closed by an end wall 33 within which the forward end of the smaller tube 40 is affixed, and sealed. The opposite, or rearward end of the smaller diameter tube 40 is sealed within the rearward burner wall $42_2$, with the terminal end thereof extending through a forward wall 51 of the chimney 50 upon and within which the tube 40 is also rotatably mounted, and sealed. Thus, the rearward end of both tubes 30, 40 are rotatably mounted and sealed within walls $42_1$, $42_2$, respectively, a more rearward and of tube 40 is further mounted and rotatably sealed within wall 51 of the chimney 50, and the rearward open end of tube 40 terminates within chimney 50 with which it is in open communication. The opening within tube 30, on the other hand, is closed off to the chimney but is in open communication with the burner box 44.

Tangential burners $43_1$, $43_2$ are mounted within the upper and lower sides, respectively, of the walls forming the burner box 44. These burners $43_1$, $43_2$ normally burn a hydrocarbon fuel admixed with air (oxygen), the flames and not gases therefrom igniting and burning the oil waste material introduced into tube 30 via feed mechanism 10. The hot luminous flame and gases fill the open volume of the outer tube 30, heating both tubes 30, 40 and exit therefrom into tube 40 via openings $22_1$, $22_2$, $22_3$, $22_4$ located around the forward wall 41 of said tube 40. The axial burner $34_1$ which also burns a hydrocarbon fuel admixed with air (oxygen) is projected through end wall 33 into the forward end of tube 40, the hot luminous flame and gases passing from the forward end rearwardly through the tube 40 to virtually completely incinerate and burn the residue already burned and calcined in tube 30. As the tubes 30, 40 are rotated, the closed ends of the series of chains 47 of short length suspended via their ends from the inner side of wall 31, along its length, are dragged through the burning matter moving along the inside of wall 31, thus transfering heat to the matter as well as loosening and suppressing any tendency of the burning matter to congeal.

Figure 2:
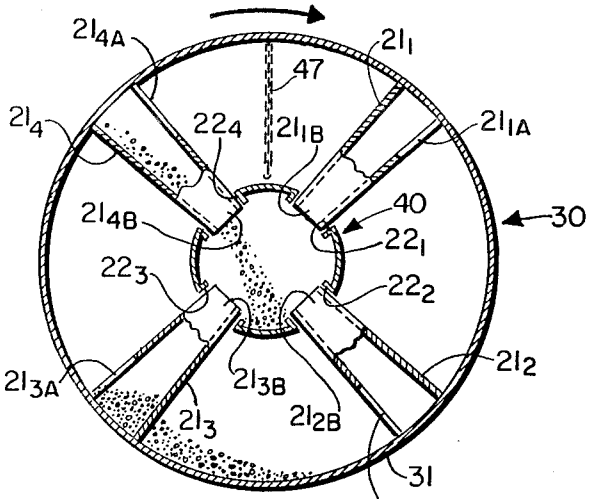
FIG. 2 is a section taken along line 2—2 of FIG. 1 depicting the elevator lift means.

The elevator, or lift mechanism 20 is best shown by continued reference to FIG. 1, and to FIG. 2. The elevator, or lift mechanism 20 is constituted of a series of scoops, or buckets $\mathbf{21}_1$, $\mathbf{21}_2$, $\mathbf{22}_3$, $\mathbf{22}_4$. One end of each of the buckets is affixed, at equally spaced locations, upon the inner wall 31 of tube 30, and an opposite tubular and thereof is affixed within and extended into an opening $\mathbf{22}_1$, $\mathbf{22}_2$, $\mathbf{22}_3$, $\mathbf{22}_4$. Each scoop, or bucket 21 contains an open side, i.e. $\mathbf{21}_{1A}$, $\mathbf{21}_{2A}$, $\mathbf{21}_{3A}$, $\mathbf{21}_{4A}$, respectively, which as it moves along the bottom of wall 31 picks up particulate matter as the tubes 30, 40 are rotated; and each hollow, tubular portion of a scoop is provided with an open end $\mathbf{21}_{1B}$, $\mathbf{21}_{2B}$, $\mathbf{21}_{3B}$, $\mathbf{21}_{4B}$ through which the particulate matter is discharged via an opening $\mathbf{22}_1$, $\mathbf{22}_2$, $\mathbf{22}_3$, $\mathbf{22}_4$, respectively, into the interior of tube 40 as the scoop, or bucket reaches an upright position. Particulate calcined solids are thus lifted from the floor at the forward end of tube 30 by the lift mechanism 20, and discharged via the openings 22 into the smaller diameter tube 40, and gases are passed via these same openings 22 from the larger diameter tube 30 into the smaller diameter tube 40.

The oil waste feed mechanism 10 is mounted at the rearward end of the skid, and includes generally a chute 11 projected through sealed and supported within the wall $\mathbf{42}_2$ of the furnace box 44, a screw conveyor 12 mounted within the straight tubular wall section forming the chute 11, a motor means or motor 13 which rests upon a horizontal platform 14 supported via structural elements not shown, and a feed hopper 15. Waste is introduced via the feed hopper 15, conveyed via the screw conveyor 12, and discharged via its discharge end upon the bottom wall 31 of tube 30.

The tubes 30, 40 are structured, and oriented in all embodiments, so that a burnable waste feed introduced via the feed mechanism 10 into the lower rearward end of tube 30 will flow downwardly cocurrent with gases from the tangential burners while being dried and then burned to the lower forward end of said tube 30, and then the residual solids, after being elevated by the elevator lift mechanism 20 and discharged through the circumferential openings 22 into the forward end of tube 40, will again flow downwardly cocurrent with the gases from the forward to the rearward terminal end of tube 40 whereupon the burning of the residual solids will be completed, and the unburned solids and gases will then be discharged into chimney 50. This orientation is accomplished, preferably in this manner: The small diameter, or rearward end of tube 40 is inclined and supported on framwork 45 at a height, or level, in which the wall 31 will slope downwardly from its rearward end to its forward end, providing a slope generally ranging from about $\frac{1}{8}$ inch to about $\frac{7}{8}$ inch, preferably from about $\frac{1}{4}$ inch to about $\frac{1}{2}$ inch, per linear foot. Moreover, the height, or level of the wall 31 about the floor of skid 70 will be such as to provide a downward slope between the forward end of wall 41 and the rearward end of wall 41 of tube 40 (represented by angle alpha in FIG. 1), generally a slope ranging from about $\frac{1}{8}$ inch to about $\frac{7}{8}$ inch, preferably from about $\frac{1}{4}$ inch to about $\frac{1}{2}$ inch, per linear foot. As a consequence, the burning waste will flow downwardly cocurrently with gases from the burner box 44 through the annulus, or annular passageway between walls 31, 41 from the feed entry end of the kiln to the closed end of tube 40, the residual solids will be lifted via the elevator mechanism 20 and introduced via circumferential openings 22, along with gases, into the forward end of tube 40 from which location the solids will flow cocurrently with gases from all of the burners downwardly to the rearward open end of tube 40 wherefrom the solids and gases will be discharged into chimney 50. Solids waste discharged into chimney 50 will be removed from a solids discharge outlet at the bottom of the chimney 50 and then transported via a conveyor 60 to a storage, dump or fill area. Combustion gases from the stack of chimney 50 will be cooled by energy recovery means and filtered, or discharged directly to the environment dependent on the specific nature of and solids content of the gases.

It is apparent that various modifications and changes can be made, e.g., in the orientation, size, shape and various materials can be used in the construction of the kiln, and adjust components, without departing the spirit and scope of the invention. For example, the wall of the outside tube of the pair of concentric tubes may be lined with fire brick, or otherwise insulated to reduce the transfer of heat from the inside to the outside of the vessel. The tubes will be constructed of metals which can withstand high temperatures, and the inside tube in particular may be constructed of an alloy such as Inconel, or other metal capable of withstanding temperatures on the order of 2000° F. more, or less.

Having described the invention, what is claimed is:

1. A rotary kiln for burning and calcining a waste oil, sludge or slurry to form gases and residual solids which comprises a pair of tubes each of which is formed by an enclosing side wall, a first tube oriented with its rearward end raised above its forward end, the forward end being closed by an end wall, a second tube concentric with and mounted inside said first tube having a diameter sufficiently small to provide an annular passageway between the side walls of said pair of tubes, said annular passageway sloping downwardly from its rearward end toward its forward end, the forward side wall end of said second tube having circumferential openings which communicate the forward end of said annular passageway with the opening extending through said second tube, said second tube being extended downwardly from its forward end to its rearward end in a direction opposite that of said connecting annular passageway formed between the two tubes, a burner box formed by enclosing side and end walls, located at the rearward end of said first tube, within the forward side wall of which a terminal end of said first tube is mounted, and rotatably sealed such that the annular passageway between said pair of tubes is in open communication therewith, and a rearward portion of said second tube is mounted and rotatably sealed within the rearward end wall of said burner box, and its terminal end extended therethrough, waste oil, sludge or slurry feed means mounted with its feed discharge end extending into the rearward end of said first tube for introducing a waste oil, sludge or slurry into the annular passageway located between the side walls of said pair of tubes, one or more burners mounted within the walls of the burner box from which burning gases are emitted into said annular passageway for igniting and burning said waste oil, sludge or slurry introduced into the annular passageway, the burning residue of said waste oil, sludge or slurry moving concurrently with the burning gases from said burners downwardly to the forward end of the annular passageway where the residue is collected and piled, elevator means located within the forward end of said first tube interfacing with said annular passageway for lifting and elevating the piled residue and introducing same via the circumferential side wall openings into the axial opening extending through said second tube, one or more burners extending through the enclosing end wall of said first tube into the forward end of said second smaller diameter tube from which burning gases are emitted, the solids and vapors within the axial opening of said second tube being contacted and calcined by the burning gases while moving cocurrently downwardly therewith to the opposite lower end of said second tube wherefrom both the burned gases and calcined solids are discharged, a chimney within a forward wall of which the rearward terminal end of said second tube is sealed and rotatably contained, the chimney being provided with a lower solids discharge outlet and stack, such that the gases and solids discharged from the rearward end of said second tube therein are separated, the gases passing upwardly through the stack and the solids being discharged via said solids outlet, and means for rotating said pair of tubes while a waste oil, sludge or slurry is being introduced via the waste oil, sludge or slurry feed means into the rearward end of said first tube, burned, and the burned solids residue passed concurrently with the flow of gas through the continuous passageways formed by the annular passageway between the two tubes and axial opening through the second tube, and discharged into the chimney.

2. A rotary kiln for burning and calcining a waste oil, sludge or slurry to form gases and residual solids which comprises a pair of tubes each of which is formed by an enclosing side wall, a first tube of frusto conic shape oriented with its rearward small diameter end raised to a level above the lower forward portion of its large diameter end, the large diameter end being closed by an end wall, a second tube concentric with and mounted inside said first tube having a diameter sufficiently small to provide an annular passageway between the side walls of said pair of tubes, said annular passageway being sloped downwardly from the rearward small diameter end toward the lower forward portion of the large diameter end of said first tube, the forward side wall end of said second tube having circumferential openings which communicate the forward end of said annular passageway with the opening extending through said second tube, said second tube being extended downwardly from its forward end to its rearward end in a direction opposite that of said connecting annular passageway formed between the two tubes, a burner box formed by enclosing side and end walls, located at the rearward small diameter end of said first tube, within the forward side wall of which a terminal end of said first tube is mounted, and rotatably sealed such that the annular passageway between said pair of tubes is in open communication therewith, and a rearward portion of said second tube is mounted and rotatably sealed within the rearward end wall of said burner box, and its terminal end extended therethrough, waste oil, sludge or slurry feed means mounted with its feed discharge end extending into the rearward small diameter end of said first tube of frusto conic shape for introducing a waste oil, sludge or slurry into the annular passageway located between the side walls of said pair of tubes, one or more burners mounted within the walls of the burner box from which burning gases are emitted into said annular passageway for igniting and burning said waste oil, sludge or slurry introduced into the annular passageway, the burning residue of said waste oil, sludge or slurry moving concurrently with the burning gases from said burners downwardly to the large diameter end of the annular passageway where the residue is collected and piled, elevator means located within the large diameter end of said first tube interfacing with said annular passageway for lifting and elevating the piled residue and introducing same via the circumferential side wall openings into the axial opening extending through said second tube, one or more burners extending through the enclosing end wall of said first tube into the forward end of said second smaller diameter tube from which burning gases are emitted, the solids and vapors within the axial opening of said second tube being contacted and calcined by the burning gases while moving cocurrently downwardly therewith to the opposite lower end of said second tube wherefrom both the burned gases and calcined solids are discharged, a chimney within a forward wall of which the rearward terminal end of said second tube is sealed and rotatably contained, the chimney being provided with a lower solids discharge outlet and stack, such that the gases and solids discharged from the rearward end of said second tube therein are separated, the gases passing upwardly through the stack and the solids being discharged via said solids outlet, and means for rotating said pair of tubes while a waste oil, sludge or slurry is being introduced via the waste oil, sludge or slurry feed means into the rearward small diameter end of said first tube, burned, and the burned solids residue passed concurrently with the flow of gas through the continuous passageways formed by the annular passageway between the two tubes and axial opening through the second tube, and discharged into the chimney.

3. The apparatus of claim 2 wherein the pair of tubes, burner box, waste oil, sludge or slurry feed means, chimney, and means for rotating said pair of tubes are mounted upon a transportable skid.

4. The apparatus of claim 3 wherein the means for rotating said pair of tubes is comprised of a circumferential gear mounted on the outer side wall of the forward large diameter end of said first tube, and a motor the drive shaft of which is provided with a gear which is meshed with said circumferential gear to drive and rotate said pair of tubes.

5. The apparatus of claim 3 wherein the means for rotating said pair of tubes is comprised of a pair of circumferential tires, laterally spaced apart one from the other and mounted on the outer side wall of said first tube, laterally spaced apart trunnions directly mounted upon the skid upon which each of the tires, respectively, are supported and rotatable.

6. The apparatus of claim 3 wherein the means for rotating said pair of tubes is comprised of a circumferential gear mounted on the outer side wall of the forward large diameter end of said first tube, a motor the drive shaft of which is provided with a gear which is meshed with said circumferential gear, a pair of circumferential tires laterally spaced apart one from the other and mounted on the outer side wall of said first tube, laterally spaced apart rollers directly mounted upon the skid upon which each of the tires, respectively, are supported, and rotatable on energinizing the motor to rotate the tubes.

7. The apparatus of claim 2 wherein the inside side wall of the first tube is arrayed along its length with one or more short lengths of chain, the lengths of chain being affixed to and suspended via their ends from said wall such that the closed ends extend into the annular passageway between the pair of tubes, the length of chain dragging through the residual solids on rotation of the tubes to enhance heat transfer and suppress agglomeration and sticking of the residue to the inside side wall of said first tube.

8. The apparatus of claim 2 wherein a plurality of burners are tangentially mounted within the side wall of the burner box.

9. The apparatus of claim 8 wherein a pair of burners are tangentially mounted within the side wall of the burner box, each on alternate sides of the burner box.

10. The apparatus of claim 2 wherein a single burner is mounted to extend through the enclosing end wall of said first tube into the forward end of said second smaller diameter tube.

11. The apparatus of claim 2 wherein the elevator means located within the large diameter end of said first tube is constituted of a plurality of spaced apart open end tubular buckets arrayed circumferentially around the inside side wall of said first tube and rotatable therewith so that the open end of a bucket in a downward position can scoop residue collected and piled at the forward lower side of said first tube at the end of the annular passageway and, in an upward elevated position can discharge the residue via its tubular end into the circumferential side wall openings of the second tube into the axial opening thereof.

12. The apparatus of claim 2 wherein the waste oil, sludge or slurry feed means is constituted of a tubular section within which a screw conveyor is located and rotatably mounted therein, the feed discharge end is extended through the rearward wall of said burner box into the rearward lower small diameter end of said first tube of frusto conic shape, and the end of the tubular section opposite the discharge end is provided with a hopper into which the feed is introduced for discharge into said first tube.

13. The apparatus of claim 2 wherein the burner box at the rearward small diameter end of said first tube is positioned and supported upon a support frame directly mounted upon the skid, the height being adjusted to provide a continuous downward slope for the annual passageway between the walls of the two tubes, and continuous downward slope in the opposite direction for the axial opening through said second tube.

14. The apparatus of claim 13 wherein the slope of the annular passageway between the two tubes ranges from about $\frac{1}{8}$ inch to about $\frac{7}{8}$ inch, per linear foot, and the slope of the axial opening through the second tube ranges from about $\frac{1}{8}$ inch to about $\frac{7}{8}$ inch, per linear foot.

15. The apparatus of claim 14 wherein the slope of the annular passageway ranges from about $\frac{1}{4}$ inch to about $\frac{1}{2}$ inch, per linear foot, and the slope of the axial opening ranges from about $\frac{1}{4}$ inch to about $\frac{1}{2}$ inch per linear foot.

* * * * *